United States Patent [19]

Marchant

[11] Patent Number: 4,579,279

[45] Date of Patent: Apr. 1, 1986

[54] ELECTROSTATIC SPRAYERS

[75] Inventor: John A. Marchant, Bedford, England

[73] Assignee: National Research Development Corporation, London, England

[21] Appl. No.: 584,926

[22] Filed: Feb. 29, 1984

[30] Foreign Application Priority Data

Mar. 3, 1983 [GB] United Kingdom ..... 8305865

[51] Int. Cl.[4] ..... B05B 5/02

[52] U.S. Cl. ..... 239/3; 239/703

[58] Field of Search ..... 239/3, 700–703, 239/690

[56] References Cited

U.S. PATENT DOCUMENTS

| | | | |
|---|---|---|---|
| 1,832,096 | 11/1931 | Chaffee et al. | 239/702 |
| 2,784,351 | 3/1957 | Renner | 239/703 X |
| 2,901,177 | 8/1959 | Norris | 239/703 |
| 2,989,241 | 6/1961 | Badger | 239/703 |
| 3,010,428 | 11/1961 | Sedlacsik | 239/703 X |
| 3,086,712 | 4/1963 | Frazier | 239/224 X |
| 3,121,533 | 2/1964 | Sedlacsik, Jr. | 239/703 |
| 3,221,992 | 12/1965 | Sedlacsik, Jr. et al. | 239/703 |
| 3,281,860 | 10/1966 | Adams et al. | 239/102 X |
| 3,285,516 | 11/1966 | Waldrum | 239/102 X |
| 3,679,132 | 7/1972 | Vehe et al. | 239/4 |
| 4,004,733 | 1/1977 | Law | 239/3 |
| 4,009,829 | 3/1977 | Sickles | 239/705 |
| 4,043,507 | 8/1977 | Wace | 239/4 X |
| 4,148,932 | 4/1979 | Tada et al. | 427/31 |
| 4,198,781 | 4/1980 | Dykes | 239/3 X |
| 4,215,818 | 8/1980 | Hopkinson | 239/3 |
| 4,221,332 | 9/1980 | Bals | 239/223 |
| 4,258,409 | 3/1981 | Porter | 239/706 X |
| 4,275,838 | 6/1981 | Fangmeyer | 239/703 X |
| 4,275,846 | 6/1981 | Coffee | 239/690 |
| 4,356,528 | 10/1982 | Coffee | 239/690 |
| 4,362,275 | 12/1982 | Coffee | 239/700 |
| 4,422,577 | 12/1983 | Arnold et al. | 239/703 |

FOREIGN PATENT DOCUMENTS

| | | | |
|---|---|---|---|
| 248444 | 12/1963 | Australia . | |
| 233700 | 10/1962 | Austria | 239/693 |
| 608728 | 1/1979 | Fed. Rep. of Germany | 239/693 |
| 2839013 | 3/1979 | Fed. Rep. of Germany | 239/223 |
| 665655 | 1/1952 | United Kingdom . | |
| 885597 | 12/1961 | United Kingdom . | |
| 887450 | 1/1962 | United Kingdom . | |
| 891342 | 3/1962 | United Kingdom . | |
| 917683 | 2/1963 | United Kingdom . | |
| 923392 | 4/1963 | United Kingdom . | |
| 1012129 | 12/1965 | United Kingdom . | |
| 1037936 | 8/1966 | United Kingdom . | |
| 1107060 | 3/1968 | United Kingdom . | |
| 1202117 | 8/1970 | United Kingdom . | |
| 1268391 | 3/1972 | United Kingdom . | |
| 1303625 | 1/1973 | United Kingdom . | |
| 1307878 | 2/1973 | United Kingdom . | |
| 1311464 | 3/1973 | United Kingdom . | |
| 1326173 | 8/1973 | United Kingdom . | |
| 1335071 | 10/1973 | United Kingdom . | |
| 1435181 | 5/1976 | United Kingdom . | |
| 1538931 | 1/1979 | United Kingdom . | |
| 1587952 | 4/1981 | United Kingdom . | |
| 2093734 | 9/1982 | United Kingdom | 239/707 |

*Primary Examiner*—Andres Kashnikow
*Assistant Examiner*—Scott Malpede
*Attorney, Agent, or Firm*—Cushman, Darby & Cushman

[57] ABSTRACT

A sprayer, particularly for hand-held or vehicle-borne agricultural use, has a rotatable sprayhead having a liquid dispersing surface in the form of disc, dish or cup, a rotatable electrode spaced from the outer edge of said surface by a gap, means for supplying liquid to the liquid dispersing surface, connections for the poles of a source of electrostatic potential to apply one pole of the source to the electrode and to apply the other pole of the source to at least the outer edge of the surface to apply the potential of the source across the gap, and means to rotate the surface and the electrode to disperse liquid supplied to the surface as a charged spray. The potential may be applied to the outer edge via the liquid if conductive or via a suitable conductive path in the sprayhead.

13 Claims, 2 Drawing Figures

ELECTROSTATIC SPRAYERS

Figure 1:
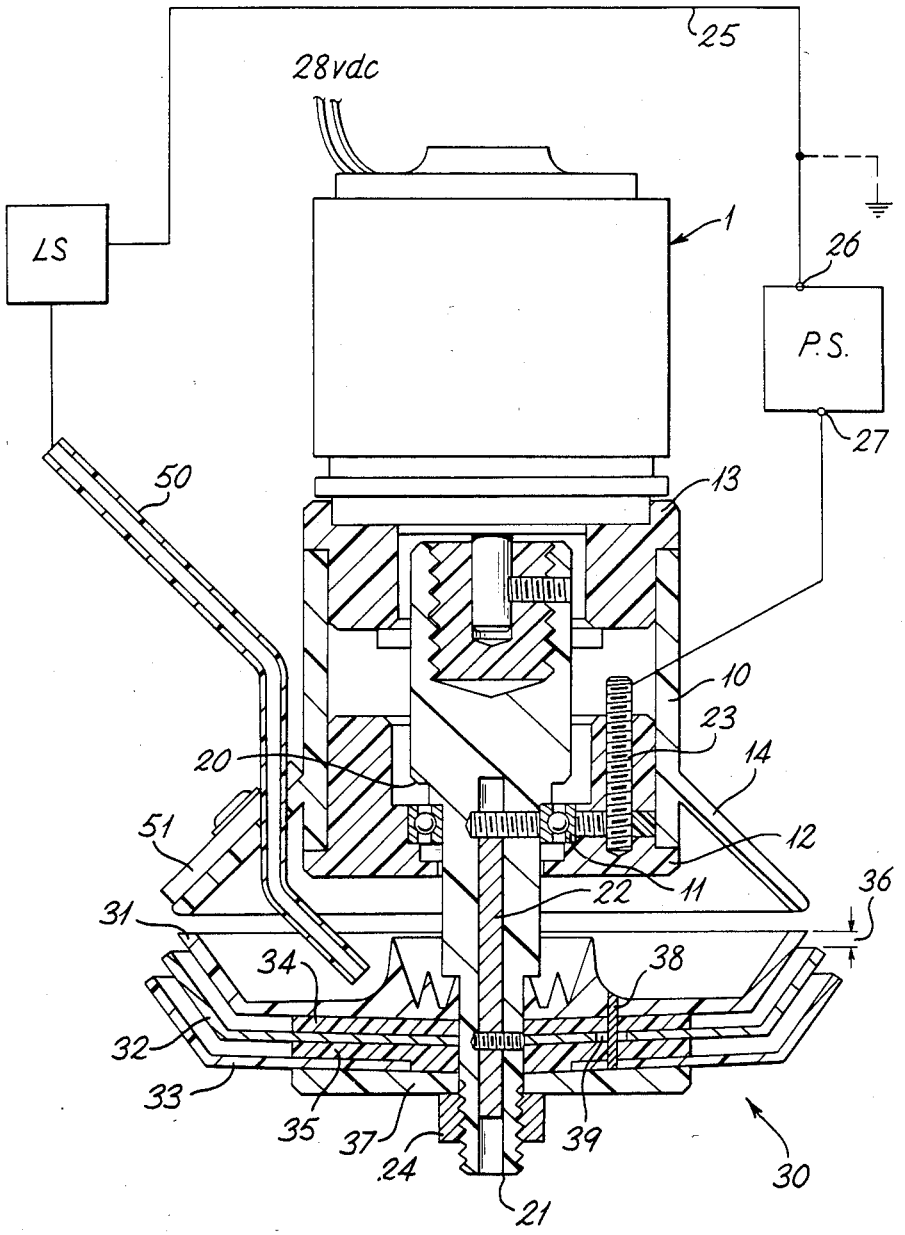

This invention relates to electrostatic sprayers.

Devices to produce a spray of electrically charged droplets of liquids such as agricultural chemicals have to operate efficiently in harsh conditions with little or no maintenance and produce an accurately controlled droplet size. For hand held use in particular the power requirements must be as low as possible both for motor drive and high voltage supply.

It is an object of the invention to provide an improved electrostatic sprayer arrangement.

According to the invention there is provided an agricultural sprayer comprising a rotatable sprayhead having a liquid dispersing surface in the form of disc, dish or cup, a rotatable electrode spaced from the outer edge of said surface by a gap, means for supplying liquid to said surface, connections for the poles of a source of electrostatic potential, means for applying one pole of said source, when connected to said connections, to said electrode and means for applying the other pole of said source, when so-connected, to at least said outer edge of the surface to apply the potential of the source across said gap, and means to rotate the surface and the electrode to disperse liquid supplied to said surface as a charged spray.

The rotatable electrode may extend outwardly of the outer edge of the liquid dispersing surface to form the gap. The liquid dispersing surface may be an insulator or a conductor. The rotatable electrode may be a disc, dish or cup or a projection from the disc, dish or cup forming the liquid dispersion surface. There may be another liquid dispersing surface spaced from the electrode on the side away from the one liquid dispersing surface. The spacing may space the outer edge of the other surface at a distance similar to the gap. The gap may be between one and five millimeters. The sprayer may be energised by or include a high voltage supply to produce a field strength in the gap of some 500 to 3,000 volts per millimeter. The high voltage supply may be some 1,000 to 6,000 volts.

According to the invention there is also provided an electrostatic sprayer arrangement for liquids including a body housing a shaft for easy rotation about an axis, the shaft supporting beyond the body a plurality of discs for rotation with the shaft in a spaced apart stack, the stack of discs including at least a first disc and a second disc spaced along the shaft, the first disc having a surface to receive a liquid for spraying as charged droplets, the second disc including an electrically insulated and conductive electrode region at least at the edge thereof defining a gap to the edge of the first disc, means to electrically connect said region to a terminal for the connection of an electrostatic supply to the arrangement to exert an electrostatic potential across said gap, means to supply said liquid to the first disc, means to cause rotation of the shaft and discs about the axis, the arrangement being such that in operation liquid supplied to the first disc when rotating is thrown off as droplets and the electrostatic supply produces an electric field across said gap to charge the droplets.

According to the invention there is provided a method of producing a spray of charged droplets of an agricultural treatment liquid including providing a disc having an electrically isolated liquid receiving surface, supporting the disc for rotation about its axis, providing an electrically conductive electrode for rotation with said disc and spacing said electrode from the edge of said disc to form a gap, energising said electrode from one pole of an electrostatic supply to create an electrostatic field in said gap, supplying liquid to the surface, causing the disc and electrode to rotate to throw off supplied liquid as droplets charged by the electrostatic field in the gap, the field being between 500 and 3,000 volts per millimeter.

The liquid may be conductive and connected to the other pole of the electrostatic supply. The disc may have a conductive edge for connection to the other pole of the electrostatic supply.

Figure 2:
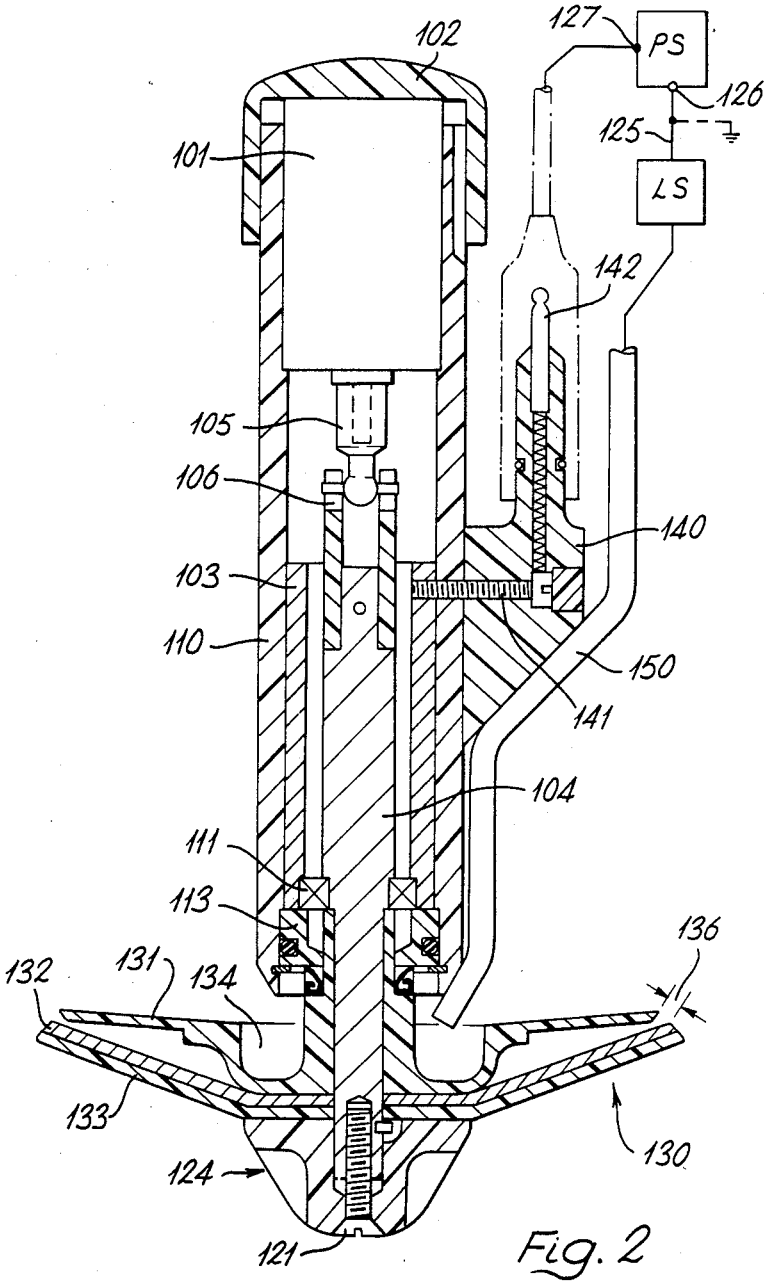

Embodiments of the invention will now be described with reference to the accompanying drawings in which:

FIGS. 1 and 2 are different sprayer arrangements embodying the invention, shown mainly in cross-sectional elevation.

FIG. 1 shows a spraying arrangement including a cover 10 which provides a support for a shaft 20 housed for easy rotation in a bearing 11. Cover 10 and shaft 20 are of electrically insulating material but bearing 11 needs to be electrically conducting in the present embodiment. Conveniently two insulating bushes 12,13 are included in cover 10 to respectively support the bearing 11 and support an electric drive motor 1. In this embodiment motor 1 is arranged to operate on 28 v.d.c. but other values are clearly usable as required. Shaft 20 is connected to the drive shaft of the motor in a suitable manner. Cover 10 extends at 14 as a cone.

Shaft 20 carries at the outer end 21 a stack of dish-shaped discs generally indicated at 30. Three discs 31,32,33 are shown. Disc 33 is not essential for all embodiments. Disc 31, the first disc, is of plastics material to be electrically insulating and is preferably provided with a grooved surface to aid dispersion of liquid as droplets when the disc is spun. Discs of this type are available commercially and suitable types will be readily apparent to those skilled in the art. The centre of the disc may be shaped to prevent liquid collecting on shaft 20. The exact form of the disc can vary to suit a specific need or constructional form. Preferably there is a cup or other depression to receive liquid but this is not essential as a flat surface is a possible form.

Disc 32 is electrically conductive, at least in a region at the edge and is spaced from disc 31 on shaft 20 by an insulator 34. Disc 32 can be slightly larger than disc 31 so that, with the insulator 34, a gap 36 is produced between the edge of disc 31 and the conductive region on disc 32. The conductive region of disc 32, which may be produced by making the disc of metal, has a connection to one pole of an electrostatic supply by conductor 22. Conductor 22 can be placed in bores in shaft 20 to reach bearing 11 to pass through to the stationary bush 12 and a conductor 23 to one terminal 27 of a high voltage supply power PS, not shown in detail, of any suitable form. The other terminal 26 of supply PS is earthed or made "earthy" for the sprayer as described below.

It is believed to be advantageous to have the disc 32 slightly larger than disc 31 so that any ligaments of liquid from disc 31 have begun to break up into drops by the time they reach the electric field produced in operation in gap 36.

When a third disc, 33, is used a further insulator 35 is provided. A nut 24 holds the stack of two or three discs on the shaft with a further spacer and cover plate 37. When the third disc is used a conductive pin 38 extends from disc 33, to be exposed at the surface of disc 31.

Disc 33 is conductive or has a conductive surface so it can be connected via pin 38, to the surface of disc 31 and any conductive surface of disc 31 or liquid thereon. An aperture 39 in disc 32 isolates pin 38 from the electrostatic voltage supplied to disc 32. If the liquid is non-conductive a connection from the other pole of the electrostatic supply to the outer zone at least of disc 31 is required.

A liquid supply pipe 50 is secured to cover 10 by a clamp 51. The pipe 50 is shaped to direct liquid towards the centre of disc 31 for even spread over the disc on its rotation. The liquid is supplied from a liquid supply LS, not shown in detail.

If the liquid is conductive then a connection 25 is provided to the terminal 26 of high voltage supply PS so that the liquid is at a different potential from the conductive region of disc 32.

If a non-conductive liquid is to be used then an "earthy" connection from terminal 26 to a conductive zone on disc 31 near gap 36 is required. This can be provided in any suitable manner, for example another through conductor in shaft 20 extending to a metallic deposit on disc 31.

Connection 25 or some other part may be earthed or made "earthy" if required to dissipate any charge accumulating on the sprayer by the action of charging the spray. The charged spray produced by the operation of the sprayer is attracted to plants growing in the ground because of the charge induced on passing the gap 36, and not by any potential difference from the sprayer to the ground.

The general form of construction is not critical, apart from attention to choice of suitable material for electrical and mechanical reasons and for resistance to chemical attack. Clearly a suitable space must be provided between cover 10 and disc 31 to allow free rotation of the disc and dispersal of the droplets of spray. Also the discs must not warp, to ensure that the gap 36 between discs 31 and 32 is maintained. Suitable dimensions for the sprayer are discussed below.

In operation liquid is fed along supply pipe 50, the motor is energised to rotate the discs and the electrostatic supply applied to disc 32. The electrostatic field at the gap between discs 31 and 32, effectively the two terminals of the high voltage supply, causes droplets of liquid thrown from disc 31 by the rotation of the disc to be charged electrically. The charging action is by induction. Although this can tend to cause collection of liquid on the sprayhead, and short circuit the electrostatic supply, by the spinning of the disc the collection of liquid is reduced and efficient operation can be achieved. If a liquid drop drips from the discs the drop can well have the "wrong" charge polarity and behave erratically, even being repelled from the target. However when the outermost metal disc, 33, is used and is kept at earth or earthy potential liquid that collects on this disc is spun off through an electrostatic field similar to that between discs 31 and 32 with the correct polarity and similar charge.

The arrangement described permits a relatively low electrostatic supply voltage to be used while still retaining an adequate field to charge the droplets. This is because only small distance, gap 36, exists between the high potential electrode, disc 32, and the earthy electrode which can be the earthed liquid itself on disc 31 if the liquid is conductive. Gap 36 can reliably be made as small as one to two millimeters so voltages of 1,000 to 3,000 volts will produce a field strength of about one thousand to two thousand volts per millimeter and preferably in excess of 500 volts per millimeter. Such fields could only be produced by much higher electrostatic potentials when the field is between the sprayer and the earthed target plants, say 100 to 500 millimeters away and requiring potential of 100,000 volts for a similar field strength.

Although the discs are shown with the high potential electrode larger in diameter than the disc which disperses the liquid this is not essential. The arrangement in FIG. 1 can be altered to bring liquid supply to both of discs 31 and 33. This may involve a hollow shaft 20 for the liquid feed and some complexity in electrical supply but these matters do not affect the charging technique and in quantity production of the sprayer need not increase the cost of the device.

The electrode need not be a separate disc. It is possible to have the electrode formed as a lip or flange or other projection near the edge of the disc with an adequate stand-off from the disc to avoid undue leakage of the electrostatic potential when the area is wetted. A single disc may then be sufficient for dispersion and charging.

FIG. 2 shows another form of the sprayer arrangement. A generally cylindrical body 110, conveniently of a plastics insulating material, houses at one end a motor 101 held by a cap 102, which allows the supply leads for the motor to emerge. The other end of the body 110 supports a multiple disc assembly 130. The drive from the motor to the disc assembly is along the axis of body 110.

A conducting sleeve 103, e.g. of aluminium, is held in the body 110 towards the disc end. Sleeve 103 houses bearing 111, which must be suitable for the conduction of an electrostatic supply voltage. Bearing 11 in turn supports a shaft 104 of conductive material. Shaft 104 extends from a coupling 105/106 to motor 101 to beyond the end of body 110 to carry the disc assembly 130 for rotation by the motor.

Coupling 105/106 consists of a ball-ended extension 105 on the shaft of motor 110 which is pinned into a tube 106, of insulating material, which extends shaft 104 and provides a flexible and electrically isolating connection between the motor and the shaft.

Outwardly of bearing 111 shaft 104 carries the disc assembly 130 which is secured in place against a shoulder in shaft 104 by an insulating cover 124 and locking screw 12. The sleeve 103 and bearing 111 are retained in body 110 by a bush 113 held in place by a circlip. An O-ring provides a water-resistant seal between the bush 113 and body 110. A lip-seal on shaft 104 resists the entry of water into body 110 through the centre of bush 113.

The disc assembly 130 has three major parts. The disc 131, nearest the body 110, is the atomising disc. This disc is of insulating material, e.g. a plastics material, if conductive liquids are to be used and has a central well 134 into which liquid is fed by conduit 150. The disc extends outwards and upwards from the well 134 to an atomising edge which is desirably fairly sharp, as opposed to rounded-off. Next away from body 110 is the electrode disc 132. This is of conductive material, for example thin metal or metallically plated plastic. This disc is dished to extend close to the edge of disc 131, and preferably slightly beyond it, producing a gap 136. Finally a cover disc 133, of insulating material, fits against the outer surface of disc 132 and extends slightly beyond the edge of disc 132.

A hollow stem extends from the well 134 of disc 131 to produce a rigid engagement with shaft 104.

A high-voltage connection to disc 132 is provided as follows. Disc 132 is in metallic contact with conductive shaft 104. Bearing 117 extends the conductive path to conducting sleeve 103. A terminal block 140 is attached to the outside of body 110 by a screw 141 which engages sleeve 103 for mechanical and electrical connection to hold the block. The block may be bonded on as well and is conveniently of ABS plastics material. A connection from screw 141 extends to a push-on high-voltage terminal 142 sealed against water entry when a connector is applied. The bearing 111 must be suitable to permit the passage of the electrostatic supply voltage.

Liquid to be sprayed is fed to the well 134 by a tube 150 attached to body 110. The body 110 can be secured to a handle or other support by a clip or other device, not shown, in any convenient manner.

FIG. 2 shows in outline the liquid flow path to tube 150 from a liquid supply LS, which can be a pressurised container, and the electrical connections from the electrostatic power supply PS. Connection 122 connects one terminal of the supply PS to the disc 132 via connection 142, above. Connection 125 connects the other terminal of the supply PS to the liquid if this is sufficiently conductive. An earth connection can be made as shown in dotted form. If the liquid is not conductive enough disc 131 must be provided with a conductive upper surface, at least at the edge, and a connection extended back to the power supply via connection 125.

The operational characteristics of the arrangment according to the invention have several useful features. Firstly small droplets can be produced without the use of small holes which easily become blocked. Grooved surfaces, well known in the art, permit reliable control of droplet size. A high flow rate is often used with hydraulic nozzles, say 30 liters per hectare minimum, to avoid blockage. The non-electrostatic disc droplet generator can operate as low as five liters per hectare, or lower, without difficulty and produce droplets much smaller than the 150 micron size usual for hydraulic nozzles. However small uncharged droplets drift, can not always travel the distance to the target and can not "wrap around" the target, for example the underside of a leaf.

The construction also protects the discs from damage, for example by use of cone 14 and cover 124, and shrouds the high potential parts to reduce the risk of shock. The sprayhead may be formed from separate elements, such as the discs described above, or made in one or two parts, for example by moulding in plastics material, with conductive surfaces produced by plating or otherwise depositing metal.

A reasonable operational characteristic for a hand-held sprayer would be five to 50 liters per hectare delivery at normal walking speed of an operator; adequate electrostatic capacity to charge at up to 0.5 millicoulombs/kilogram/kilovolt; and a low electrostatic potential.

In one form the discs shown in FIG. 1 are about 80 millimeters in diameter and are rotated at several thousand r.p.m. typically 5,000 to 9,000 r.p.m. Clearly the size and speed can be adjusted for hand or vehicle use. One apparent limitation of the small gap, 36, is the risk of corona. However fields in excess of some 3,000 volts per millimeter are needed for this to occur so there is a reasonable margin and only moderate care in use is needed in keeping the discs clean and undamaged. Larger gaps say, five millimeters, can be used with appropriate voltages. Charge to mass ratios of 0.6 ml/kg to 2.2 ml/kg have been achieved at flow rates of 0.5 to 2.0 ml/second and with potentials up to 6 kV and gaps up to 5 mm. Ratios of 1.5 ml/kg are readily achieved for almost any combination of potential, gap and flow rate in these ranges. However it appears that with smaller gaps, say, 1 to 2 mm a peak of charge/mass ratios is reached at about 2 kV with a ratio of around 2 ml/kg, which is a very useful value. Corona discharge from the droplet forming liquid ligaments probably causes the fall-off at higher potentials.

Tests have been carried out to show the effect of variation of electrostatic potential and disc speed using the 80 millimeters disc stack. Without an electrostatic potential on the spray head the overall deposit on test targets, the conventional spirally-wrapped tapes, was about $2.3\times10^{-8}$l/cm$^2$ at 6,000 r.p.m. and $1.4\times10^{-8}$l/cm$^{-2}$ at 9,000 r.p.m. However the variation between the deposit on the front surface and on the back surface (as seen from the spray head) was very large. The front surface received between 5 and $3.8\times10^{-8}$l/cm$^2$ while the back surface received only about one-twenthieth of this, between 0.2 and $0.15\times10^{-8}$l/cm$^2$.

When the electrostatic potential was applied both the total deposit and the balance between front and back surface improved. The total deposit at 6,000 r.p.m. was $4.5\times10^{-8}$l/cm$^2$ and $3.8\times10^{-8}$ at 9,000 r.p.m. The front surface received between 6.5 and $6\times10^{-8}$l/cm$^2$ while the back surface received between 2.7 and $1.6\times10^{-8}$l/cm$^{-2}$, better than one-fourth of the front surface deposit.

The above technique thus provides a very versatile and effective sprayer arrangement in which electrostatic potential is effectively used to improve droplet application. Clearly the exact form of the arrangement can vary from the embodiments described. Two discs only may be used, the constructional form may be varied, the use of low conductivity liquids may require the first disc to have a conductive surface, but these variants will be apparent to those skilled in the art. The low electrostatic power requirements make hand-held operation possible with battery drive for the disc motor and high voltage supply, while vehicle-borne equipment could use a common power unit for the electrostatic supply of several disc units as the low voltage and power demands would permit distribution without too much loss.

I claim:

1. A sprayer comprising:

a rotatable sprayhead having a liquid dispersing surface in the form of disc, dish or cup, a rotatable electrode spaced from the outer edge of said surface by a gap and separated from said surface by the body of said disc, dish or cup, means for supplying liquid to said surface, connections for the poles of a source of electrostatic potential, means for applying one pole of said source, when connected to said connections, to said electrode, means for applying the other pole of said source, when so-connected, to at least said outer edge of the surface to apply the potential of the source across said gap, and means to rotate the surface and the electrode to disperse liquid supplied to said surface past said gap as a charged spray.

2. A sprayer according to claim 1 in which the rotable electrode extends outwardly of said outer edge to form said gap.

3. A sprayer according to claim 1 for a conductive liquid in which the liquid dispersing surface is an insulator or electrically isolated from said electrode and said other pole is connected to said means for supplying liquid for application of said potential to said outer edge by the conductive liquid to be sprayed from the sprayer.

4. A sprayer according to claim 1 in which the outer edge is conductive and connected to a connection for said other pole to apply the potential of said source across the gap even when a non-conductive liquid is to be sprayed from the sprayer.

5. A sprayer according to claim 1 in which the rotatable electrode is a disc having at least a surface which is conductive and spaced from the liquid dispersing surface to define said gap.

6. A sprayer according to claim 1 including another liquid dispersing surface spaced from said electrode on the side away from said one liquid dispersing surface and an electrical connection between said one liquid dispersing surface and said another liquid dispersing surface.

7. A sprayer according to claim 6 in which said another liquid dispersing surface is conductive.

8. A sprayer according to claim 6 in which the outer edge of said another surface is spaced from said electrode by a distance similar to that of said gap.

9. A sprayer according to claim 1 including a shaft supported in a housing by a bearing for rotation by a motor, the shaft extending from the housing, the disc, dish or cup to provide the liquid dispensing surface and a disc, dish or cup to provide the electrode mounted spaced apart on the shaft, a high voltage connection for said one pole mounted on the housing and a conductive path through the housing, the bearing and the shaft to the electrode.

10. A sprayer according to claim 1 in which the gap is between one millimeter and five millimeters.

11. A sprayer according to claim 1 including a source of electrostatic potential arranged to produce a field in said gap of between 500 and 3,000 volts per millimeter.

12. A method of producing a spray of charged droplets of an agricultural treatment liquid including:

providing a disc having an electrically isolated liquid receiving surface, supporting the disc for rotation about its axis, providing an electrically conductive electrode for rotation with said disc and spacing said electrode from the edge of said disc to form a gap, separating said receiving surface from the electrode with the body of said disc, energising said electrode from one pole of an electrostatic supply to create an electrostatic field in said gap of between 500 to 3,000 volts per millimeter, supplying liquid to the surface, causing the disc and electrode to rotate to throw off supplied liquid past the gap as droplets charged by the electrostatic field in the gap.

13. An electrostatic sprayer arangement for liquids including:

a body housing a shaft for easy rotation about an axis, the shaft supporting beyond the body a plurality of discs for rotation with the shaft in a spaced apart stack, the stack of discs including at least a first disc and a second disc spaced along the shaft, the first disc having a surface to receive a liquid for spraying as charged droplets, the second disc including an electrically insulated and conductive electrode region at least at the edge thereof defining a gap to the edge of the first disc and being separated from said surface by the body of said first disc, means to electrically connect said region to a terminal for the connection of an electrostatic supply to the arrangement to exert an electrostatic potential across said gap, means to supply said liquid to the first disc, means to cause rotation of the shaft and discs about the axis, the arrangement being such that in operation liquid supplied to the first disc when rotating is thrown off past the gap as droplets and the electrostatic supply produces an electric field across said gap to charge the droplets.

* * * * *